US005450712A

United States Patent [19]

Van Scoyk

[11] Patent Number: 5,450,712

[45] Date of Patent: Sep. 19, 1995

[54] SPURS FOR RIDING SHOES

[76] Inventor: Pershing R. Van Scoyk, 7193 W. 32nd Ave., Wheatridge, Colo. 80033

[21] Appl. No.: 238,505

[22] Filed: May 5, 1994

[51] Int. Cl.[6] ..... A43C 17/00

[52] U.S. Cl. ..... 54/83.1

[58] Field of Search ..... 54/83.1, 83.2

[56] References Cited

U.S. PATENT DOCUMENTS

| | | | |
|---|---|---|---|
| 725,604 | 4/1903 | Straus et al. | 54/83.2 |
| 969,839 | 9/1910 | Buermann | 54/83.2 |
| 2,487,461 | 11/1949 | McKinney | 54/83.1 X |

*Primary Examiner*—Robert P. Swiatek

*Attorney, Agent, or Firm*—Dorr, Carson, Sloan and Birney

[57] ABSTRACT

A spur having a U-shaped body formed from rigid material such as metal and shaped to affix to a heeled athletic/riding shoe. The spur of the present invention includes a receiver bracket at each of the forward ends of the U-shaped body for guiding a strap under the heel and over the upper insole. The receiver bracket is designed to create a pivot point which does not allow the spur to ride up on the athletic/riding shoe and maintains the spur in a properly aligned and comfortable position.

17 Claims, 2 Drawing Sheets

SPURS FOR RIDING SHOES

BACKGROUND OF THE INVENTION

1. Field of the Invention

The present invention relates, in general, to spurs for horseback riders, and, more particularly, to a spur that mounts on a heeled athletic/riding shoe with a strap.

2. Statement of the Problem

Horse riders use spurs to prod and communicate with their horses. Historically, a spur is attached to the rider's footwear. A horse rider's footwear, which is called a riding boot or shoe or cowboy boot, has a heel and a counterheel. The heel is the built-up portion of the footwear under the wearer's heel. The counterheel is that part of the footwear above the heel of the footwear that wraps around the wearer's own heel. Conventional riding boots or shoes are made of natural or synthetic leather or the like. The heel is slightly larger than the counterheel at the point where the two meet so that an upper peripheral surface of the heel forms a shoulder and a small crevice or groove is formed between the counterheel and heel.

Prior spurs include a body which engages the footwear of the rider, a shank, and a rowel. The shank extends from the rear of the spur body and acts as the prod. A rowel, which is a toothed rotatable wheel, may be inserted into the distal end of the shank.

The body traditionally is a stiff U-shaped band that fits around the heel of the boot. Conventional spurs have straight sides and are positioned so that the sides span horizontally forward from the rear of the boot. The U-shaped band is shaped and sized so as to fit a boot where the sole and heel are substantially wider than the upper portion of the boot.

Conventional spurs are affixed to the boot using buttons or slots formed at the forward end of each of the sides of the U-shaped band. Buttons are small round projections riveted onto the spur sides at the forward end. A strap goes up and over the upper portion of the boot and attaches to both ends of the spur at the buttons. Using buttons, there is no way to determine the angle at which the straps will go over the boot due to the fact that the button is round and the strap is not inhibited in any way from rotating to various positions.

Another way of attaching spurs to the boots is slots. Two horizontal, parallel slots are formed in the forward end of the side of the spur. An English spur is a typical example of a slotted spur. The slots are horizontal with respect to the shoe and parallel to each other. A strap is threaded through both of the slots and under the shoe, and back through the slots on the other side. The strap is passed over the shoe and the ends of the strap are attached together on the top. Because the user must pass the strap through two slots, it is somewhat difficult to use. Also, because the slots are horizontal to the shoe and each of the straps are parallel to each other, there is very little control over the angle at which the strap passes over the boot.

A point at which the strap passes through each of the slots or attaches to a button is called a "pivot point" because it is the point at which the force applied to the strap is in turn applied to the spur. Hence, the spur will pivot about the pivot point. A spur will fit poorly and be uncomfortable if the pivot point is not properly designed.

An increasing number of experienced riders are now using heeled athletic/hiking shoes, hereinafter referred to as "riding shoes" suitable for riding instead of conventional leather riding boots. Riding shoes are more comfortable, more versatile, less expensive, and easier to care for than conventional leather boots. These advantages mean that the market for riding shoes is expanding rapidly.

However, because the overall shape of the riding shoe is different from that of riding boots, conventional spurs often do not properly fit the heeled athletic/riding shoe, causing the spur to move or "ride up" on the riding shoe. The athletic shoes are longer from heel to toe and from the heel to the upper insole. Also, athletic shoes have a tongue, laces, and use materials which increase the overall size from heel to toe. The sole, heel, and counterheel in an athletic shoe are substantially the same width. The heel counter is narrow compared to the heel counter of a conventional riding boot, so traditional spurs slip off or ride up on the athletic shoe. A need exists for a spur that properly and comfortably mounts to a heeled athletic/riding shoe, and that does not move in relation to the riding shoe when in use.

3. Solution to the Problem

The present invention provides a spur that is easily placed on or removed from a heeled athletic/hiking shoe suitable for riding. The spur is preferably a U-shaped body formed from rigid material such as metal and shaped to fit around and remain properly aligned to an outer surface of a heeled athletic/riding shoe. The spur of the present invention includes a receiver bracket at each of the forward ends of the U-shaped body for guiding a strap under the heel and over the upper insole. The receiver bracket is designed to create a pivot point which does not allow the spur to ride up on the athletic/riding shoe and maintains the spur in a properly aligned and comfortable position.

SUMMARY OF THE INVENTION

The present invention provides a spur that includes a curved rear body and two sides extending horizontally forward from the rear body, to form a cavity that permits the spur to be placed over the heel of a heeled athletic/hiking shoe suitable for riding. The forward end of each of the sides angles upward and a receiver bracket is formed thereon. The receiver brackets include an upper slot and a lower slot with a raised portion between the upper and lower slots. The upper and lower slots are preferably aligned skew to each other. The two sides extend farther forward than conventional spurs to position the bracket or slot correctly with respect to the riding shoe.

To use the spur in accordance with the present invention, a strap is passed under the sole of the boot and through the receiver bracket formed on the angled extension. The receiver bracket guides the strap under the heel to shift the strap forward on the heel thereby allowing a more comfortable fit on a heeled athletic/-riding shoe. The receiver bracket also guides the two ends of the strap over the upper instep at an angle, creating a pivot point that applies a forward and upward force on the spur to affix the spur to the riding shoe in a proper and comfortable position.

DETAILED DESCRIPTION OF THE DRAWING

1. Overview

Figure 1:
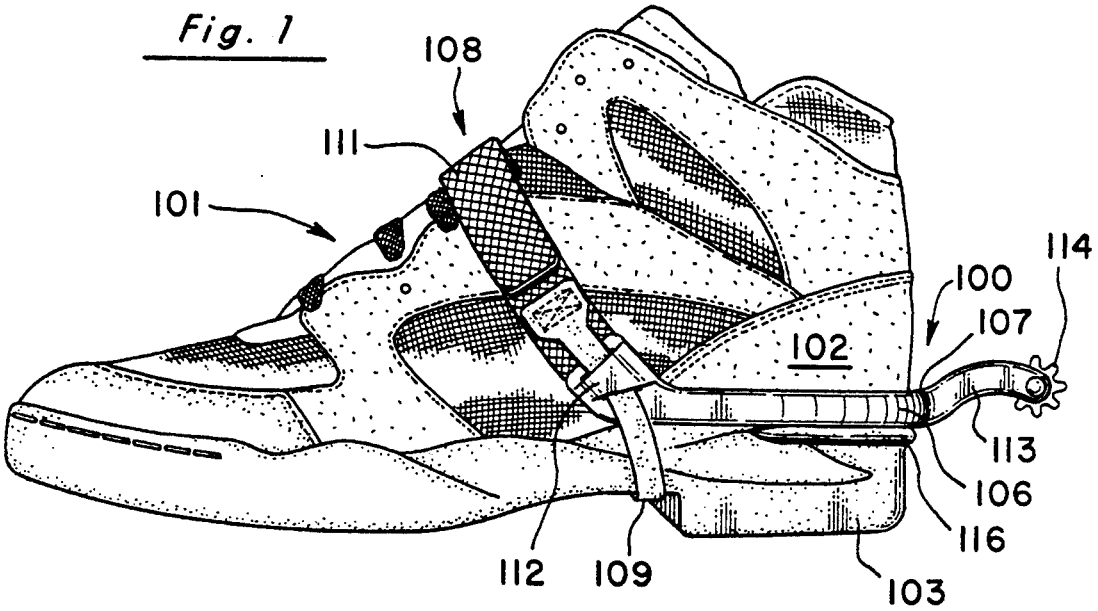
FIG. 1 shows a side elevation view of a first embodiment spur in accordance with the present invention attached to a riding shoe.

FIG. 1 illustrates an improved spur 100 in accordance with the present invention affixed to a riding shoe 101. Riding shoe 101 is a heeled athletic/hiking shoe suitable for riding. Riding shoe 101 includes a counterheel 102 and a heel 103. Heel 103 is substantially the same width as counterheel 102. Riding shoe 101 can be manufactured to include an integral ridge 116 along the sides of the shoe 101. Also, the integral ridge 116 may extend around a rear portion of the shoe. It should be understood that riding shoe 101, including ridge 116, are not a part of the present invention. However, the innovations and improvements employed to adapt spur 100 to properly fit and engage riding shoe 101 are within the scope of the present invention.

Unlike the heel of a conventional boot a riding shoe heel 103 can be made of a resilient material. Also, counterheel 102 may be made of a softer, more flexible material than the leather or plastic used in conventional boots. Riding shoe 101 is manufactured from a variety of materials in combination including rubbers, plastics, natural and synthetic leather, suede, canvas, and the like.

Spur 100 includes two sides 106 (one of which is visible in FIG. 1) which are connected to each other by rear portion 107 to form a U-shaped body. Sides 106 extend forwardly away from rear portion 107 in a substantially horizontal orientation with respect to riding shoe 101 when spur 100 is properly mounted on riding shoe 101. Preferably, sides 106 rest on ridges 116 in use to help reduce vertical motion of spur 100.

Rear portion 107 attaches to shank 113. Shank 113 includes an upright, longitudinal slot in its distal portion to support rowel 114. Rowel 114 is conveniently mounted in the longitudinal slot with a pin as shown in FIG. 1. Preferably, shank 113 and rear portion 107 are formed as an integral, one-piece structure.

Figure 2:
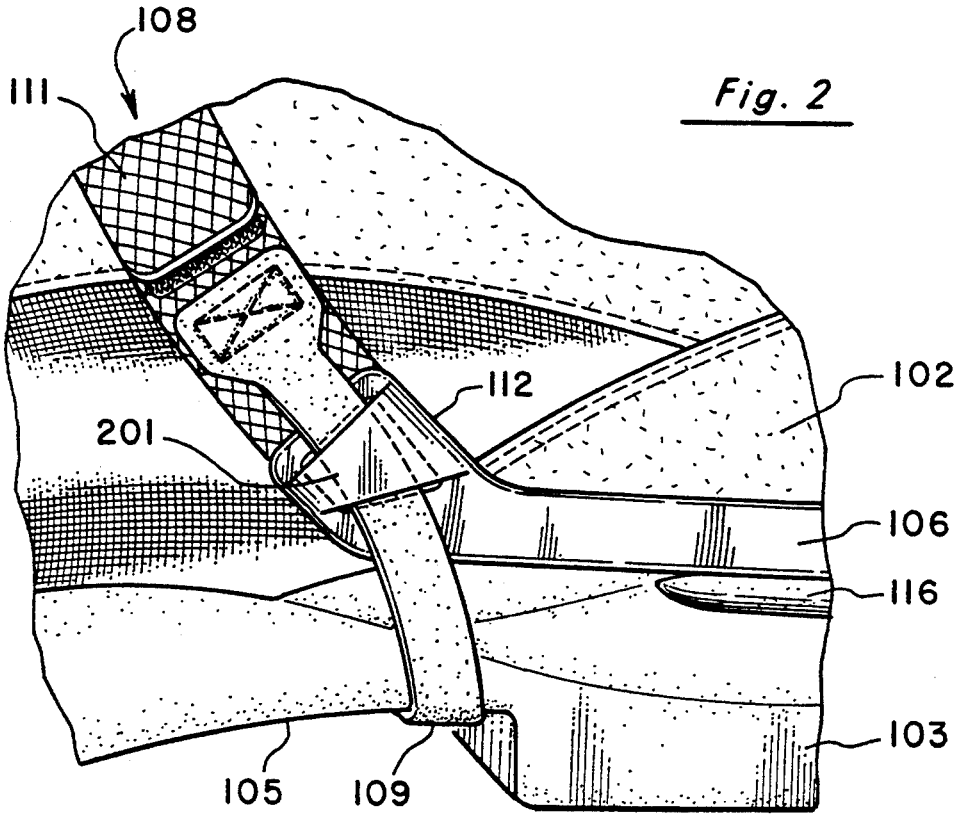
FIG. 2 is an enlarged view of a portion of the spur shown in FIG. 1.

Receiver brackets 112 are formed at the forward end of each side 106 and angle upwardly from the horizontal span of sides 106. A strap 108, including lower portion 109 and upper portion 111, affixes spur 100 to riding shoe 101. As best seen in FIG. 2, lower strap portion 109 frictionally engages a portion of sole 105. Upper strap portion 111 passes over and engages the upper insole, tongue, and laces of riding shoe 101. Strap 108 serves to apply an upward and forward force to spur 100. The upward and forward forces on spur 100 results from strap 108 pulling on receiver brackets 112, which serves as a pivot point, and lower strap portion 109 acting as a fulcrum.

In a preferred embodiment, strap 108 is a single strap which passes through slots or brackets 201 formed on each receiver bracket 112. As strap 108 is tightened, the upward and forward forces applied to spur 100 increase. When a single strap is used, the frictional forces which engage strap portion 109 to sole 105 and strap portion 111 to the upper insole increase simultaneously and proportionally with the increase in the forces applied to spur 100. Hence, the simple action required to tighten strap 108 serves to reliably affix and comfortably adjust spur 100 to suit a particular rider's desires.

Although spur 100 in accordance with the present invention, including sides 106, rear portion 107, and shank 113 are preferably formed as a single part in the preferred embodiment, it should be understood that other manufacturing techniques may be used. For example, each part can be formed separately and subsequently joined to form an assembled spur 100. Also, spur 100 is illustrated as having shank 113 and rowel 114 permanently attached, but it should be understood that these portions may be made removable or replaced with a blunt prod without departing from the teachings of the present invention. Further, spur 100 may be useful for other types heeled footwear such as work shoes, rock climbing shoes, or similar special purpose shoes which require attachments that can be removeably mounted to the footwear.

2. Spur Body Design

Figure 3:
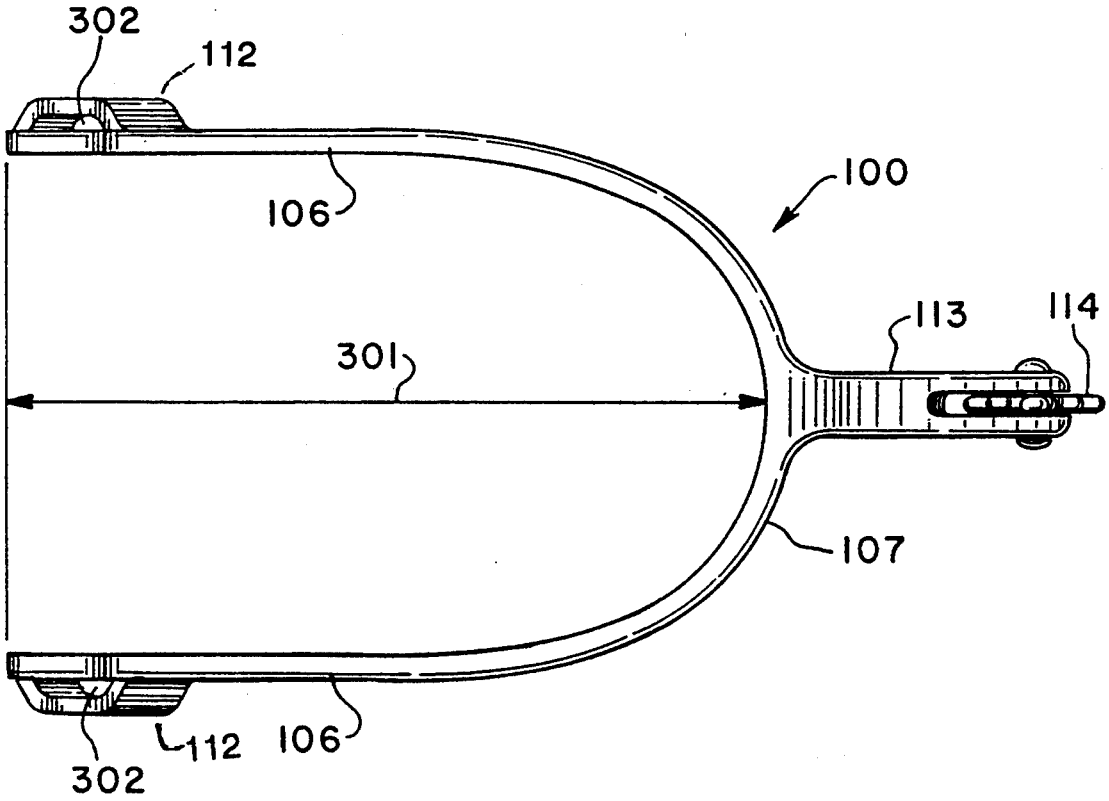
FIG. 3 is a top plan view of a spur in accordance with the present invention.
Figure 4:
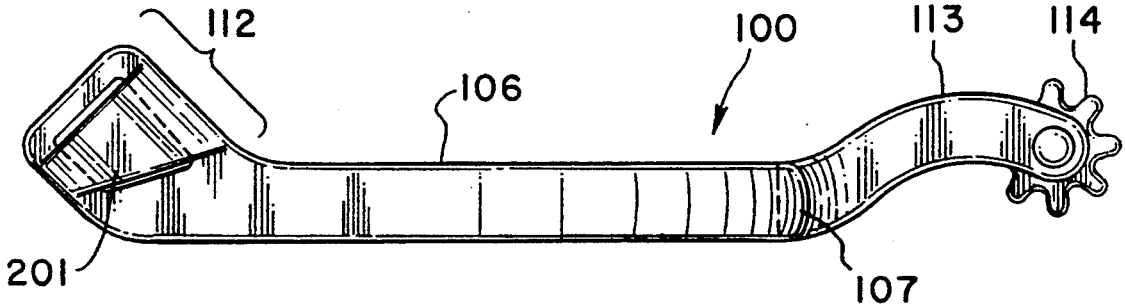
FIG. 4 is a side plan view of the spur shown in FIG. 3.

FIG. 3 and FIG. 4 illustrate details of a spur 100 in accordance with the present invention. FIG. 3 shows a top plan view of a preferred embodiment. A rearward end of each of sides 106 is joined to rear portion 107 to form a substantially U-shaped body that matches the outline of heel 103 (shown in FIG. 1). Thickness of side walls 106 and rear portion 107 are a matter of design choice and depend upon the rigidity of the material used. In a preferred embodiment, a rigid material such as steel is used for spur 100. Shank 113 is attached to rear portion 107 and rowel 114 is attached to shank 113 so as to allow rowel 114 to rotate or spin.

To properly align a spur with the athletic shoe, the sides must be lengthened so that the overall band length 301 is substantially longer than traditional spurs. In a particular example, the band length 301, which is the inner length of the spur measured from one forward end to the other forward end, is about 9.75 inches. This extended band properly aligns the spur with the shoe and allows a comfortable fit.

Also, rear portion 107 of spur 100 is provided with a relatively small circumference to fit the narrower counterheel 102 of the riding or heeled athletic shoe 101. By extending sides 106, lower strap portion 109 (shown in FIG. 2) is pushed forward with respect to the rear of the athletic shoe 101. This moves the fulcrum of the spur attachment forward. The pivot point of the spur in accordance with the present invention, which is formed by tunnel 302 of receiver bracket 112 is also moved forward. The combination of the fulcrum and pivot point positioning leads to a more comfortable fit and prevents the spur from riding up on the athletic shoe.

It should be understood that any rigid material or combination of materials may be used to form sides 106, rear portion 107, receiver bracket 302 and shank 113. For example, other metals or plastic may be used. The outer surfaces of the spur in accordance with the present invention may be finished by polishing, plating, overcoating, or the like. Likewise, decorative elements and features may be added or attached to the outer surface.

3. Receiver Bracket Design

As shown in FIG. 3, receiver bracket 112 is formed by a raised portion which extends outwardly away from each side 106 to form a tunnel 302. Tunnel 302 is designed to allow strap 108 (shown in FIG. 1) to pass through. Tunnel 302 guides strap 108 under and over riding shoe 101. Preferably, tunnel 302 is built in to spur 101 as an integral, single piece structure. This lowers manufacturing cost, and creates a pivot point such that strap 108 creates both upward and forward forces on spur 101. It has been found that this pivot point keeps the spur in a proper and comfortable position.

FIG. 4 shows a side plan view of the preferred embodiment spur highlighting the features of receiver bracket 112. Receiver bracket 112 is set at an angle so as to guide strap 108 (shown in FIG. 1) as it passes through tunnel 302 (shown in FIG. 3). The angle is chosen to shift lower portion 109 of strap 108 slightly forward from heel 103 as shown in FIG. 2. Lower portion 109 acts as a fulcrum when spur 100 is in use, so shifting lower portion 109 forward changes the location of forces applied to riding shoe 101. This is a distinct advantage because athletic shoe 101 is thicker, and the forward setting provides a more comfortable fit.

Another feature of the spur in accordance with the present invention is that the upper entrance to tunnel 302 is set skew to the lower entrance. This allows receiver bracket 112 to determine an angle for upper portion 111 to pass over riding shoe 101 independently from the angle at which lower portion 109 passes under riding shoe 101. This independent determination allows precise control over the forces applied by strap 108 to spur 101. In the preferred embodiment, receiver bracket 112 angles upward at 60 degrees, the upper entrance to tunnel 302 is parallel to the end of receiver bracket 112, and the lower entrance to tunnel 302 is angled at approximately 30 degrees. All of the angles are indicated with reference to a line running parallel with the length of sides 106.

The dimensions of the preferred embodiment may be readily adapted to a particular shape of riding shoe 101. Likewise, the shapes are chosen to mate with the outer surface of counterheel 102 and heel 103 as well as to give spur 100 aesthetic appeal. The dimensions and shapes recited in the particular examples are provided only to aide understanding and are not limitations of the present invention.

4. Method of Making the Spur

Although a variety of well-known machining techniques can be employed to make the spur according to the present invention, a preferred method using a metal material such as steel is set out below. A U-shaped body having a curved rear portion 107 and two sides 106 extending forwardly from the rear body is formed similarly to conventional spurs. The U-shaped body is sized and arranged so as to provide an inner surface for frictionally engaging heeled athletic shoe 101.

Receiving bracket 112 is formed on a forward end of each of sides 106. Receiving bracket 112 is angled upwardly at a first angle with respect to the sides. Receiving bracket 112 may be formed at the same time as the U-shaped body, or may be welded or otherwise attached to the ends of sides 106. Receiving bracket 112 is preferably made by forming a flat, upwardly angled extension on the forward end of each of the sides. An upper slot is cut in the extension such that the upper slot is oriented at a second angle with respect to the sides. A lower slot is cut in the extension such that the lower slot is oriented at a third angle with respect to the sides.

Once the upper and lower slots are cut, a bridge-shaped portion remains in the extension between the upper and lower slots. The bridge-shaped portion of the extension is bent outwardly to create tunnel 302. The upper slot forms an upper entrance to the tunnel and the lower slot forms a lower entrance to the tunnel.

While the particular embodiments have been described using a machined metal material, other rigid materials and manufacturing processes are known which can be adapted to produce a spur in accordance with the present invention. Also, the spur may be larger or smaller than the specific embodiments to adequately affix to a particular shoe. It is to be expressly understood that the claimed invention is not to be limited to the description of the preferred embodiment but encompasses other modifications and alterations within the scope and spirit of the inventive concept.

We claim:

1. A spur for mounting on a riding shoe having a heel and a counterheel that is substantially as wide as the heel, the spur comprising:

at least two opposing sides;

a rear body connected to a first end of each of the sides to form a U-shaped band; and means rigidly affixed to a second end of each of the sides and angled upwardly from the sides for receiving a strap, so that the spur is firmly held in place on said riding shoe.

2. The spur of claim 1, the receiving means further comprising a tunnel portion positioned so that the strap passes through the tunnel portion.

3. The spur of claim 2, wherein said tunnel portion includes an upper entrance having a first angle to respect to the sides and a lower entrance oriented at a second angle to the sides, said first angle for determining the angle at which the strap crosses an upper portion of the riding shoe and said second angle for determining the position of a lower portion of the strap.

4. The spur of claim 1 wherein said at least two sides and said rear body comprise a rigid material.

5. The spur of claim 1 wherein said receiving means provides a pivot point so that the strap applies forward and upward forces to the spur.

6. The spur of claim 1 wherein each of the sides has a length so that the receiving means guides a lower portion of the strap to a position forward of the heel.

7. A spur for mounting removably on a heeled athletic shoe suitable for riding, the spur comprising:

a rear body;

a shank attached to said rear body;

two sides extending frontwardly from said rear body and attached to the rear body to form a U-shaped band;

a receiving bracket rigidly affixed to a front end of each of the two sides, the receiving bracket having a portion protruding outwardly from the sides to form a tunnel for guiding a strap at a first angle upwardly over the shoe and at a second angle under the shoe, wherein the first and second angles are different to prevent the spur from moving upwardly and downwardly.

8. The spur of claim 7, wherein the tunnel is positioned outside a vertical plane of the sides.

9. The spur of claim 7, wherein the tunnel has an upper entrance oriented at a first angle with respect to the sides and a lower entrance oriented at a second angle with respect to the sides.

10. The spur of claim 7 wherein said receiving bracket provides a pivot point so that the strap applies forward and upward forces to the spur.

11. A spur for mounting removably on a heeled athletic shoe suitable for riding, the spur comprising:

a rear body;

a shank attached to said rear body;

two sides extending frontwardly from said rear body and attached to the rear body to form a U-shaped band;

a receiving bracket disposed at a front end of each of the two sides, the receiving bracket having a portion protruding outwardly from the sides to form a tunnel for guiding a strap at a first angle upwardly over the shoe and at a second angle under the shoe to prevent the spur from moving upwardly or downwardly, wherein the rear body, two sides, and receiving bracket are formed as an integral, single piece structure.

12. An improved spur for mounting on a heeled athletic shoe suitable for riding, the spur having a rear body, two sides extending frontwardly in spaced, parallel relation from said rear body, wherein the improvement comprises:

a receiving bracket rigidly affixed to a front end of each of the two sides, the receiving bracket oriented upwardly at a first angle with respect to the sides to guide a strap over the shoe and to guide the strap under the shoe to a position forward of the heel.

13. The spur of claim 12, the receiving bracket further comprising a portion protruding outwardly from the sides to form a tunnel for guiding the strap at the first angle upwardly over the shoe and at a second angle under the shoe.

14. The spur of claim 12, the receiving bracket further comprising a portion protruding outwardly from the sides to form a tunnel wherein the tunnel has an upper entrance oriented at a second angle with respect to the sides and a lower entrance oriented at a third angle with respect to the sides such that the second angle determines the orientation of the strap as it passes over the shoe and the third angle determines the position of the strap with respect to the heel as the strap passes under the shoe.

15. The spur of claim 14 wherein the receiving bracket forms a pivot point which allows the strap to pull the spur both forwardly and upwardly.

16. A method of making a spur, said method comprising the steps of:

forming a U-shaped body having a curved rear portion and two sides extending forwardly from the rear body, said U-shaped body arranged so as to provide an inner surface for frictionally engaging a heeled athletic shoe; and forming a receiving bracket rigidly affixed to a forward end of each of the sides, the receiving bracket angled upwardly at a first angle with respect to the sides, the receiving bracket adapted to receive and guide a strap.

17. The method of claim 16 wherein step of forming a receiving bracket further comprises the steps of:

forming a flat, upwardly angled extension on the forward end of each of the sides;

cutting an upper slot in the extension, the upper slot oriented at a second angle with respect to the sides;

cutting a lower slot in the extension, the lower slot oriented at a third angle with respect to the sides; and bending a bridge-shaped portion of the extension which is located between the first and second slots outwardly to create a tunnel, the upper slot forming and upper entrance to the tunnel and the lower slot forming a lower entrance to the tunnel.

* * * * *